United States Patent [19]

Donnelly

[11] Patent Number: 4,927,523

[45] Date of Patent: May 22, 1990

[54] ADDITION OF SHAPE SELECTIVE ZEOLITES TO CATALYTIC CRACKING UNITS

[75] Inventor: Susan P. Donnelly, Yardley, Pa.

[73] Assignee: Mobil Oil Corporation, New York, N.Y.

[21] Appl. No.: 282,785

[22] Filed: Dec. 12, 1988

[51] Int. Cl.[5] ..... C10G 11/05; C10G 11/18

[52] U.S. Cl. ..... 208/120; 208/152; 208/153; 502/67; 502/71

[58] Field of Search ..... 208/153, 152, 120; 502/67, 71

[56] References Cited

U.S. PATENT DOCUMENTS

| | | | |
|---|---|---|---|
| 3,207,689 | 9/1965 | van Driesen | 208/152 |
| 3,779,898 | 12/1973 | Youngblood | 208/164 |
| 4,082,513 | 4/1978 | Andon et al. | 208/152 |
| 4,309,279 | 1/1982 | Chester et al. | 208/135 |
| 4,309,280 | 1/1982 | Rosinski et al. | 208/120 |
| 4,416,765 | 11/1983 | Chester et al. | 502/67 |
| 4,536,282 | 8/1985 | Rollmann | 208/154 |
| 4,810,360 | 3/1989 | Haddad et al. | 208/152 |
| 4,818,738 | 4/1989 | Chu et al. | 502/67 |

FOREIGN PATENT DOCUMENTS

| | | | |
|---|---|---|---|
| 0167325 | 6/1985 | European Pat. Off. | 208/152 |
| 0168979 | 6/1985 | European Pat. Off. | 208/152 |

*Primary Examiner*—Anthony McFarlane

*Attorney, Agent, or Firm*—A. J. McKillop; C. J. Speciale; R. D. Stone

[57] ABSTRACT

Shape selective zeolites, such as ZSM-5, are added to the equilibrium catalyst in a catalytic cracking unit in large amounts. Sufficient fresh zeolite is added to result in an unacceptable increase in production of wet gas ($C_3/C_4$) by the catalytic cracking unit, if operated at normal charge rates and operating conditions. To compensate, conditions in the catalytic cracking unit are adjusted, such as by reducing feed rate, catalyst/oil ratio, or cracking reaction temperature, to reduce the production of "light ends" to an amount which can be tolerated by the catalytic cracking unit. Within a few days to a few weeks, excessive production of wet gas will diminish so that unit operation may be returned to normal. Resumption of normal cracking operations using a catalyst inventory containing a relatively large amount of shape selective zeolite additive results in significant increases in the octane number of the catalytically cracked gasoline.

15 Claims, No Drawings

ADDITION OF SHAPE SELECTIVE ZEOLITES TO CATALYTIC CRACKING UNITS

BACKGROUND OF THE INVENTION

The invention is an improvement in the catalytic cracking process.

Catalytic cracking of hydrocarbons with zeolite-containing catalyst is a well-known process.

In fluidized catalytic cracking, the hydrocarbons contact fluidized catalyst and are cracked to lighter products.

The catalyst is deactivated by coke deposition, necessitating regeneration of coked catalyst in a regenerator.

Zeolitic materials, both natural and synthetic, have been demonstrated in the past to have catalytic properties for various types of hydrocarbon conversions. Certain zeolites are ordered, porous crystalline aluminosilicates having a definite crystalline structure within which there are a large number of smaller cavities which may be interconnected by still smaller channels. These materials are known as molecular sieves.

Many methods have been developed for preparing a variety of synthetic aluminosilicates. These aluminosilicates have come to be designated by letter or other symbol, e.g., Zeolite A (U.S. Pat. No. 2,882,243), Zeolite X (U.S. No. 2,882,244), Zeolite Y (U.S. No. 3,130,007), and ZSM-5 (U.S. No. 3,702,886), merely to name a few.

ZSM-5 is a particularly interesting zeolite. Much work has been reported in the patent literature on adding ZSM-5 to the conventional cracking catalyst in a catalytic cracking unit.

In U.S. Pat. No. 3,758,403, from 2-½ to 10 wt. % ZSM-5 catalyst was added to a conventional cracking catalyst containing 10 percent REY, the remainder being Georgia clay. Examples were given showing use of 1.5, 2.5, 5 and 10 wt. % ZSM-5 added to the conventional cracking catalyst.

The shape selective zeolites, e.g., ZSM-5, increase production of LPG ($C_3/C_4$ olefins) in cracking units and cause some loss of gasoline yield, and an increase in octane number.

ZSM-5 catalyst, especially virgin catalyst, has exceedingly high activity. Researchers have attempted to take advantage of the super activity of fresh ZSM-5 catalysts by adding only small amounts of it to FCC catalyst. Such work is shown in U.S. Pat. No. 4,309,280. This patent taught adding very small amounts of powdered, neat ZSM-5 catalyst, characterized by a particle size less than 5 microns.

This patent taught that adding as little as 0.25 weight percent ZSM-5 powder to the circulating catalyst inventory in an FCC unit would increase wet gas or LPG production by 50 percent.

Because of the high initial activity of the ZSM-5 catalyst, and increased wet gas production due to the addition of large amounts of ZSM-5, refiners are reluctant to start up a unit with, or add quickly to a unit, a relatively large amount of virgin ZSM-5 catalyst.

If only very small amounts of ZSM-5 catalysts are added, there will be no problem with excessive wet gas production, but the effect of adding ZSM-5 may not be apparent for days or weeks, by which time normal variations in feed, or unit operation, may obscure the octane enhancing affect of ZSM-5 addition.

A good way to add a modest amount of ZSM-5 to an FCC unit is disclosed in EP 0168979, published European Application No. 85304367.7 (F-2955 EPO). The method involves adding ZSM-5 catalyst to the equilibrium catalyst in an FCC unit in a programmed manner so that an immediate boost in gasoline product octane number, typically 178 -2 octane number, is achieved.

Although the method works well in practice, it requires careful monitoring of ZSM-5 addition over a period of many days, and results in only a modest amount of ZSM-5 catalyst being added to the equilibrium catalyst. The upper limit on ZSM-5 addition taught in the published European Application is typically enough ZSM-5 to achieve an immediate 2.0 octane number gainm with the possibility being left open to add enough ZSM-5 to go to a 3.0 octane number gain. The limiting factor is the ability of the wet gas compressor of the catalytic cracking unit to deal with the enhanced wet gas production associated with adding large amounts of ZSM-5.

A good way of adding ZSM-5 to a moving bed catalytic cracking unit is disclosed in published European Application No. EP 0167325A3. The make-up catalyst may contain 2 or 3 times the amount of ZSM-5 sought for the equilibrium catalyst.

Accordingly, refiners have not been able to add as much ZSM-5, or other shape selective zeolite additives which behave in a similar manner, as desired because of the constraints placed on such addition by the unit's wet gas compressor.

A way has now been discovered to overcome this restraint, and add relatively large amounts of shape selective zeolites, such as ZSM-5, to a catalytic cracking unit without exceeding the compressor limits.

BRIEF SUMMARY OF THE INVENTION

Accordingly, the present invention provides A method of adding an additive zeolite having a constraint index of 1-12 to a catalytic cracking unit wherein a heavy feed is added at a given feed rate to a catalytic cracking unit and contacts a source of hot, regenerated equilibrium catalytic cracking catalyst to produce cracked products including gasoline having an octane number, $C_3/C_4$, and heavy products boiling above the gasoline boiling range, and wherein the severity of the catalytic cracking operation is controlled to achieve a predetermined conversion of feed to desired products characterized by adding at least 0.5 wt. % additive, based on zeolite content of the additive and the total weight of the equilibrium catalyst in the catalytic cracking unit, to the catalytic cracking unit within a 24 hour period to produce an unacceptable increase in $C_3/C_4$ production; adjusting at least one of the feed rate and the severity of the catalytic cracking operation to reduce the production of $C_3/C_4$ to an acceptable level; aging in the catalytic cracking unit the zeolite additive, said aging reducing the cracking activity of the additive zeolite and thereby reducing the production of $C_3/C_4$; and increasing at least one of the feed rate and the severity of the catalytic cracking operation to normal levels without producing unacceptable amounts of $C_3/C_4$, and recovering a gasoline boiling range product having an increased octane number.

In another embodiment the present invention provides a method of adding ZSM-5 catalyst to an FCC unit containing an inventory of equilibrium catalyst comprising adding within a 48 hour period at least 2.0 wt. % ZSM-5 zeolite having a high initial cracking activity to the equillibrium catalyst inventory, based on the weight of ZSM-5 zeolite on a matrix-free basis and on the total weight of the equilibrium catalyst inventory, said addition being in an amount sufficient to cause an increase of at least 20 mole % of the volume of $C_3/C_4$ normally produced during catalytic cracking; changing the operation of the catalystic cracking unit to reduce the production of $C_3/C_4$ said additive zeolites and continuing the cracking operation for at least 48 hours and reducing the high initial cracking activity to a reduced activity; and thereafter restoring operation of the catalytic cracking unit to normal operation and recovering gasoline product having an increased octane no. as compared to gasoline product produced before the addition of ZSM-5.

In a more limited embodiment the present invention provides method of adding ZSM-5 zeolite to a fluidized catalytic cracking unit comprising adding 0.5–2.5 wt. % ZSM-5 zeolite, on a matrix free basis, in a 48 hour period; reducing at least one of the fresh feed rate and reaction severity to reduce the production of $C_3/C_4$ ends; and thereafter increasing over at least a one week period at least one of the reaction severity and fresh feed rate to restore operation of the catalytic cracking unit to normal.

DETAILED DESCRIPTION

SHAPE SELECTIVE ZEOLITE

Any zeolite having a constraint index of 1-12 can be used herein. Details of the constraint Index test procedures are provided in J. Catalysis 67, 218–222 (1981) and in U.S. No. 4,711,710 (Chen et al), both of which are incorporated herein by reference.

Preferred shape selective zeolites are exemplified by ZSM-5, ZSM-11, ZSM-12, ZSM-23, ZSM-35, ZSM-38, ZSM-48, ZSM-57 and similar materials.

ZSM-5 is described in U.S. No. 3,702,886, U.S. Pat. Re. No. 29,948 and in U.S. No. 4,061,724 (describing a high silica ZSM-5 as "silicalite").

ZSM-11 is described in U.S. No. 3,709,979.
ZSM-12 is described in U.S. No. 3,832,449.
ZSM-23 is described in U.S. No. 4,076,842.
ZSM-35 is described in U.S. No. 4,016,245.
ZSM-38 is described in U.S. No. 4,046,859.
ZSM-57 is described in U.S. No. 4,046,859.

These patents are incorporated herein by reference.

Preferably relatively high silica shape selective zeolites are used, i.e., with a silica/alumina ratio above 20/1, and more preferably with a ratio of 70/1, 100/1, 500/1 or even higher.

ZSM-5 zeolite is preferred, because it is a well known and a proven zeolite additive for use in catalytic cracking units.

Quite a lot of work has been done on making zeolites, such as ZSM-5, with different materials, ranging from all silica to materials containing silica and some other tetravalent metal such as boron, iron, gallium, etc. In lieu of, or in addition to, being incorporated into the zeolite framework, these and other catalytically active elements can also be deposited upon the zeolite by any suitable procedure, e.g., impregnation.

As used herein a named zeolite is defined by its crystal structure. The term ZSM-5 refers to a material which has substantially the same crystal structure as shown in U.S. Pat. No. 3,702,886. Substitution of different cations, or changing the silica/alumina, or silica/boron ratio, may result in minor modifications of the X-ray diffraction patterns of the crystalline material so produced, but it is still ZSM-5, and contemplated for use herein.

FLUID BED CATALYTIC CRACKING

This is a very common process, and a detailed description thereof is not believed necessary. Somewhat oversimplified, catalyst contacts oil in a fluidized state, cracking the oil and coking the catalyst. Coke is burned from the catalyst in a fluidized regeneration zone to regenerate the catalyst, with regenerated catalyst being recycled to react further with hydrocarbon feed.

More details of the fluidized catalytic cracking process are disclosed in U.S. Pat. Nos. 4,309,279 and 4,309,280.

MOVING BED CATALYTIC CRACKING

Moving bed catalytic cracking is a well known, mature process and a detailed discussion thereof is not believed to be necessary.

It is more difficult to add shape selective zeolite additives to moving bed catalytic cracking units that to FCC units. This is because catalyst circulation ibn moving bed units is much slower. Catalyst might take several hours to complete one complete cycle through reaction and regeneration. The catalyst passes through the unit as a moving bed, not as a fluidized bed, so there is much less opportunity for mixing of catalyst to occur. Catalyst mixing will occur, but it takes days for good mixing of catalyst to be achieved, whereas almost complete mixing of fluidizable additive catalyst with the equilibrium catalyst in an FCC unit occurs within 30–60 minutes of additive addition.

Heretofore, the best method known of adding ZSM-5 to a moving bed catalytic cracking unit was to use a makeup catalyst containing an enhanced amount of ZSM-5 relative to the equilibrium catalyst, e.g., the makeup catalyst would contain twice as much as the desired amount of ZSM-5 sought in the equilibrium catalyst. This method is effective, but many weeks of operation are needed to oobserve the affects of ZSM-5 or other shape selective zeolite.

SHAPE SELECTIVE ZEOLITE ADDITION

In general terms, the refiner will add enough of the additive zeolite to significantly increase the additive zeolite content of the equilibrium catalyst.

Enough additive zeolite should be added to increase the zeolite additive content by at least 1.0 weight percent, expressed as weight percent zeolite additive (matrix free basis) to the total weight of equilibrium catalyst in the unit. Preferably, 1.5, or 2.0 weight percent, or even more of the zeolite additive is added to the unit within a 24-hour period.

For ease in practicing the present invention, a very good addition regime is to add the desired amount of e.g., ZSM-5 over a 1 to 2 day period. Addition of 2.0 weight percent additive zeolite to the unit over a two day period, perhaps added every 4 or 8 hours, provides a fast, efficient way to get large amounts of zeolite additive into the catalytic cracking unit in way that can be easily carried out by refinery personnel.

Addtion every 4–8 hours in this manner will result in a number of step changes in $C_3/C_4$ production. The plant operators can be instructed to lower fresh feed rate, lower riser top temperature (in the case of FCC), adjust catalyst/oil ratios, reduce feed preheat, leave more carbon on regenerated catalst, or take such other measures as are necessary to reduce production of $C_3/C_4$ to an amount that can be tolerated by the wet gas compressor of the catalytic cracking unit.

After two days, catalyst addition can be stopped, and unit operating conditions increased in severity to the maximum permitted by the unit's wet gas compressor over the next 1-2 weeks.

An ideal time to practice the present invention would be when the catalytic cracking unit is already operating, or scheduled for operation, in a relatively low severity mode of operation. Thus, if catalytic cracking conditions are adjusted to maximize production of fuel oil, this minimizes somewhat the amount of gasoline and light ends that are produced. Such low severity operation is also characterized by a relative lower octane number gasoline product, which increases the need for zeolite additives such as ZSM-5 which increase the octane number of the gasoline.

ACID ACTIVITY

The acid activity, or cracking activity, of the shape selective zeolites will vary greatly with silica/alumina ratio. In general, the more aluminum present, the more active acid sites on the catalyst. Conventional ZSM-5 catalyst loses activity fairly rapidly in an FCC unit, probably due to a slight steaming effect that occurs in the FCC regenerator. In TCC units the activity decline occurs, but not so rapidly.

Various modifiers, e.g., Ag, may be added to the ZSM-5 catalyst to improve its steam stability. Such modifiers form no part of the present invention. If modified ZSM-5 catalysts are used, it may be necessary to adjust somewhat the rate of addition of the modified ZSM-5 catalyst.

EQUILIBRIUM CATALYST

If the equilibrium catalyst has been severly deactivated, the addition of ZSM-5 will have a bigger effect than if a more active equilibrium catalyst was present in the unit.

Most, but not all, FCC units operate with a catalyst comprising a large pore zeolite, typically a rare earth exchanged Y, or ultrastable Y zeolite in an amorphous matrix. Typically the FAI activity of this catalyst will be 40 to 70.

The fluid activity index (FAI) is a method used to measure the relative cracking activity of fluidized catalyst. The test is carried out in a fixed fluidized bed containing 180 g of the catalyst using a standardized feed, Light East Texas gas oil, with 3% water (based on feed) added. The standard test conditions are atmospheric pressure, 850° F./454° C., a weight hourly space velocity of 6, a catalyst-to-oil ratio of 2, and a time on stream of 5 minutes. The product is a gasoline having a 90% boiling point of 180° C. Conversion is defined as 100% minus LV% cycle oil product.

OPERATING CONDITIONS

The severity of the operation may have an effect upon target octane. Addition of a given amount of ZSM-5 catalyst to a unit operating at relatively low severity conditions may produce a different effect than addition of the same amount of ZSM-5 catalyst to a unit operating under very severe conditions.

FEEDSTOCK

Any conventional cracking unit feed may continue to be used as feed to the FCC unit during the practice of the present invention. The octane no. response of different feeds to ZSM-5 catalyst may be different.

COMPARISON EXAMPLE 1

The following example represents the prior art method of adding ZSM-5, namely adding enough to see a 1.5 octane number gain. The example is taken from EP 0 167 325 A3.

ZSM-5 ACTIVITY DECAY

The most important variable in determining a ZSM-5 addition rate is the rate of activity decay of the ZSM-5 catalyst added to the FCC unit.

If the catalyst activity did not decline, but remained undiminished, there would be no need to practice the present invention. Addition of a given amount of ZSM-5 catalyst on the first day of operation would, without further ZSM-5 addition, achieve the desired boost in product octane number. Such operation, as desirable as it may be, has never been attained so after about one day of operation more fresh ZSM-5 catalyst must be added to compensate for the loss in activity of the ZSM-5 catalyst already in the FCC unit.

A typical ZSM-5 addition rate necessary to achieve a constant increase in octane will be given. The precise addition rates are dependent upon all of the variables discussed above. The basic operating conditions for this exercise are listed below.

1. Equilibrium catalyst 13% REY in a silica/alumina matrix average particle size 40 to 120 microns, 58 FAI activity.
2. ZSM-5 additive—the additive consisted of 25 wt. % HZSM-5 (which had not been subjected to steaming or calcining) in a silica/alumina matrix (75 wt. %). The FAI activity of the additive composite (which is a mixture of ZSM-5 and silica/alumina) was around 68.
3. FCC operating conditions, including regeneration conditions, are shown in Table 1.
4. Feedstock properties are also shown in Table 1.

TABLE I

| Operating Conditions | |
|---|---|
| Fresh Feed, TBD/m$^3$/hr | 15.3/101.4 |
| C/O, Catalyst/Oil-Weight | 6.6 |
| Riser Top Temp., °F./°C. | 967/519 |
| Maximum regenerator Temp., °F./°C. | 1310/710 |
| Oil/Preheat Temp., °F./°C. | 735/391 |
| Catalyst Activity, FAI | 58 |
| Catalyst Inventory, Tons | 60 |
| **Charge Stock Characterization** | |
| Density, g/cc | 0.927 |
| API | 21.8 |
| S, wt. % | 0.5 |
| Molecular Weight | 375 |
| Basic Nitrogen, ppm | 570 |
| $C_A$, wt. % | 17.3 |
| Conradson Carbon Residue, wt. % | 0.06 |

Based on these assumptions, the wt. % additive necessary to achieve a 1.5 octane no. boost is presented hereafter in Table 2. This is a projection based upon our pilot plant results and mathematical models, it does not represent an actual commercial scale test.

TABLE 2

| Example of ZSM-5 Catalyst Makeup +1.5 Research Octane Increase | | | |
|---|---|---|---|
| From (Day) | To (Day) | Additive Makeup Rate at % of Inventory per day | ZSM-5 Makeup Rate as % of Inventory per |
| 0 | 1 | 3.6 to 3.7 | 0.75 to 0.9 |
| 1 | 3 | 0.96 | 0.192 to 0.24 |
| 3 | 6 | 0.70 | 0.14 to 0.175 |
| 6 | 12 | 0.60 | 0.12 to 0.15 |
| 12 | 18 | 0.52 | 0.108 to 0.13 |
| 18 | 30 | 0.46 | 0.092 to 0.115 |
| 30+ | | 0.38 | 0.08 to 0.095 |

The reason that additive amounts are reported in two ways is that the additive comprises 20 wt. % ZSM-5, with the remaining portion being a silica/alumina binder. The silica/alumina is not inert, it has some cracking activity, so for completeness both the ZSM-5 portion added, and the total additive (consisting of ZSM-5 plus its binder) is reported above.

The addition rate takes into account the small amounts of ZSM-5 present in the circulating catalyst removed as additional catalyst is added. It also assumes that both catalysts attrit from the unit at the same rate.

The equilibrium ZSM-5 additive catalyst has a much lower FAI activity than does the equilibrium catalyst, so eventually more fresh REY cracking catalyst must be added to maintain overall catalyst activity in the unit at a predetermined level.

This dilution effect, of the REY zeolite conventional cracking catalyst with the additive, can be minimized either by using a more concentrated ZSM-5 additive catalyst, or incorporating some conventional REY zeolite into the additive catalyst so that the overall fAI activity of a unit is not changed. The additive dilution effect could be largely avoided by using as an additive catalyst a ZSM-5+matrix which contained, on an overall weight percent basis, about 12% REY.

ILLUSTRATIVE EBODIMENT (Invention)

The following represents a preferred manner of adding ZSM-5 to an FCC unit.

The amount of ZSM-5 added, on a pure zeolite basis, would be 0.5–2.5% of inventory in 24–48 hours. For a 25% ZSM-5 zeolite additive, 2–10% of additive (four times as much) would be required.

The preferred ZSM-5 addition schedule is continuous, using a catalyst pump. Otherwise the ZSM-5 would be added in equal slugs very 4–6 hours over a 24–48 hour period.

The changes in the unit that would have to be made to accomodate the slugs of ZSM-5 area a reduction of fresh feed rate and/or conversion (via decreasing riser top temperature or increasing preheat) of 5–25%. However, these can be restored to base levels over the next 1–2 week. When feed rate, riser top temperature and compressor loading have returned to base levels, the octane boost in the gasoline product will still persist, declining gradually over the next 2 months. Slugging can then be repeated during periods of low FCC unit feed rate/severity.

Comparing the method of the present invention to the prior art method, the use of slugging addition of ZSM-5 results in significantly greater addition of ZSM-5, in a much shorter time, than could be achieved using the method of the published European Application. These enhanced ZSM-5 levels result in more production of higher octane gasoline than could be achieved using the prior art method.

I claim:

1. A method of adding an additive zeolite having a constraint index of 1–12 to a catalytic cracking unit wherein a heavy feed is added at a given feed rate to a catalytic cracking unit and contacts a source of hot, regenerated equilibrium catalytic cracking catalyst to produce cracked products including gasoline having an octane number, $C_3/C_4$ hyrdrocarbons and heavy products boiling above the gasoline boiling range, and wherein the severity of the catalytic cracking operation is controlled to achieve a specified conversion of feed to products characterized by (a) adding at least 0.5 wt. % additive, based on zeolite content of the additive and the total weight of the equilibrium catalyst inventory in the catalytic cracking unit, to the catalytic cracking unit within a 24 hour period to produce an unacceptable increase in $C_3/C_4$ production;

(b) adjusting the feed rate or the severity of the catalytic cracking operation or both to reduce the production of $C_3/C_4$ to an acceptable level;

(c) aging in the catalytic cracking unit the zeolite additive, said aging reducing the cracking activity of the additive zeolite and thereby reducing the production of $C_3/C_4$; and (d) increasing the feed rate or the severity of the catalytic cracking operation or both to achieve the specified conversion of feed without producing unacceptable amounts of $C_3/C_4$, and recovering a gasoline boiling range product having an increased octane number.

2. The method of claim 1 wherein at least 2.5 wt. % ZSM-5 additive is added within a 48 hour period.

3. The method of claim 1 wherein reaction severity, as measured by conversion of fresh feed into gasoline and heavy products boiling below the boiling range of the feed, is reduced by at least 10% for every 1 wt. % zeolite additive added to the equilibrium catalyst.

4. The method of claim 1 wherein the catalytic cracking process is a fluidized catalytic cracking process.

5. The method of claim 4 wherein the fluidized catalytic cracking process is operated using a riser reactor and wherein the severity of the process is controlled by adjusting the riser top temperature to reduce severity and reduce production of C3/C4 to an acceptable amount.

6. The method of claim 1 wherein the feed rate to the unit is reduced to reduce the production of $C_3/C_4$ to an acceptable level.

7. The method of claim 1 wherein the catalytic cracking unit is a moving bed catalytic cracking unit.

8. The method of claim 1 wherein the catalyst is regenerated under catalyst regeneration conditions to produce regenerated equilibrium catalytic cracking catalyst having a carbon level and an activity catalyst regeneration at catalyst regeneration condition and the catalyst regeneration conditions are adjusted to increase carbon levels on regenerated equilibrium catalyst cracking catalyst and reduce catalytic activity so as to reduce production of $C_3/C_4$.

9. The method of claim 1 wherein the additive is ZSM-5.

10. A method of adding ZSM-5 catalyst to a fluidized catalytic cracking unit containing an inventory of equilibrium fluidized catalytic cracking catalyst and operating at a specified conversion of feed to products wherein a heavy fresh feed is added at a given feed rate the catalytic cracking unit and contacts a source of hot, regenerated equilibrium fluidized catalytic cracking catalyst to produce cracked products including gasoline having an octane number, $C_3/C_4$ hydrocarbons and heavy products boiling above the gasoline boiling range comprising (a) adding within a 48 hour period at least 2.0 wt. % ZSM-5 zeolite having a high initial cracking activity to the equilibrium catalyst inventory, based on the weight of ZSM-5 zeolite on a matrix-free basis and on the total weight of the equilibrium catalyst inventory, said addition being in an amount sufficient to cause an increase of at least 20 mole % of the volume of $C_3/C_4$ normally produced during catalytic cracking;

(b) changing the operation of the catalytic cracking unti to reduce the production of $C_3/C_4$ and continuing the cracking operation for at least 48 hours; and (c) thereafter restoring operation of the catalytic cracking unit to achieve the specified conversion of feed to cracked products and recovering gasoline product having an increased octane number as compared to gasoline product produced before the addition of ZSM-5.

11. The method of claim 10 wherein in step (b) conversion of fresh feed into gasoline and heavy products boiling below the boiling range of the feed, is reduced by at least 10% for every 1 wt. % ZSM-5 zeolite additive added to the equilibrium catalyst.

12. The method of claim 10 wherein the fluidized catalytic cracking process is operated using a riser reactor and wherein the severity the process is controlled by adjusting the riser top temperature and in step (b) wherein the riser top temperature is decreased to reduce production of $C_3/C_4$ to an acceptable amount.

13. The method of claim 10 wherein the feed rate to the unit is reduced to reduce the production of $C_3/C_4$ to an acceptable level.

14. The method of claim 10 wherein the catalyst is regenerated under catalyst regeneration conditions to produce regenerated equilibrium catalytic cracking catalyst having a carbon level and an activity and the catalyst regeneration conditions are adjusted to increase carbon levels on regenerated equilibrium catalytic cracking catalyst and reduce catalytic activity so as to reduce production of $C_3/C_4$.

15. A method of adding ZSM-5 zeolite to a fluidized catalytic cracking unit operating with a starting fresh feed rate and a starting reaction severity to convert fresh feed into cracked products comprising C3 and C4 hydrocarbons, said method comprising (a) adding 0.5–2.5 wt. % ZSM-5 zeolite, on a matrix free basis, in a 48 hour period;

(b) reducing the fresh feed rate or reaction severity or both to reduce the production of C3 and C4 hydrocarbons; and (c) thereafter increasing over at least a one week period the reaction severity and fresh feed rate to their starting rates.

* * * * *

UNITED STATES PATENT AND TRADEMARK OFFICE

CERTIFICATE OF CORRECTION

PATENT NO. : 4,927,523

DATED : 5/22/90

INVENTOR(S) : S.P. Donnelly

It is certified that error appears in the above-identified patent and that said Letters Patent is hereby corrected as shown below:

Col. 8, claim 8, lines 57-58, delete "catalyst regeneration at catalyst regeneration condition"

Col. 8, claim 8, line 60, "catalyst" should be --catalytic--

Signed and Sealed this

Twelfth Day of May, 1992

*Attest:*

DOUGLAS B. COMER

*Attesting Officer*

*Acting Commissioner of Patents and Trademarks*